US006687925B2

(12) United States Patent
Minnick

(10) Patent No.: US 6,687,925 B2
(45) Date of Patent: Feb. 10, 2004

(54) LOAD RESISTANT FLOOR DRAIN ASSEMBLY

(75) Inventor: Michael W. Minnick, North Ridgeville, OH (US)

(73) Assignee: Oatey Co., Cleveland, OH (US)

( * ) Notice: Subject to any disclaimer, the term of this patent is extended or adjusted under 35 U.S.C. 154(b) by 0 days.

(21) Appl. No.: 10/103,255

(22) Filed: Mar. 21, 2002

(65) Prior Publication Data

US 2002/0148039 A1 Oct. 17, 2002

Related U.S. Application Data

(60) Provisional application No. 60/283,063, filed on Apr. 11, 2001.

(51) Int. Cl.[7] ..... A47K 3/22
(52) U.S. Cl. ..... 4/613; 4/286; 4/292
(58) Field of Search ..... 4/286, 287, 288, 4/289, 292, 613; 210/162, 163, 164

(56) References Cited

U.S. PATENT DOCUMENTS

| | | | | |
|---|---|---|---|---|
| 1,836,491 A | | 12/1931 | Niedecken et al. | |
| 1,999,277 A | | 4/1935 | Boosey | |
| 2,859,452 A | * | 11/1958 | Seewack | 210/165 |
| 4,146,939 A | | 4/1979 | Izzi | |
| 4,455,693 A | * | 6/1984 | Cuschera | 4/286 |
| 4,655,913 A | * | 4/1987 | Boersma | 210/163 |
| 4,910,811 A | | 3/1990 | Izzi, Sr. | |
| 4,943,100 A | | 7/1990 | Emberson | |
| 5,448,854 A | | 9/1995 | Hirsch et al. | |
| 5,878,448 A | | 3/1999 | Molter | |

* cited by examiner

*Primary Examiner*—Gene Mancene
*Assistant Examiner*—Azadeh Kokabi
(74) *Attorney, Agent, or Firm*—Renner, Otto, Boisselle & Sklar, LLP

(57) ABSTRACT

A floor drain assembly includes a barrel assembly having a radially outwardly flared drain area surrounded by an outer ledge for supporting the outer periphery of a grate covering the drain area. Radially inwardly of the ledge are a plurality of supports integral with the barrel assembly and/or grate for providing additional support for the span of the grate.

15 Claims, 3 Drawing Sheets

LOAD RESISTANT FLOOR DRAIN ASSEMBLY

CROSS-REFERENCE TO RELATED APPLICATIONS

This application claims the benefit of U.S. Provisional Application Serial No. 60/283,063, filed Apr. 11, 2001.

FIELD OF THE INVENTION

This invention relates to a load resistant drain assembly for connecting an area of a floor to a plumbing system for draining effluents.

BACKGROUND OF THE INVENTION

Floor drain assemblies are installed into the floor of a structure where there will be or is the potential for water to be present. Floor drain assemblies connect such flooring area to a waste removal system that is typically a storm or sanitary sewer. To incorporate a floor drain assembly seamlessly with the floor, there is a need for the drain assembly to be able to distribute or dissipate any dynamic or static loads experienced by the drain assembly to the floor.

SUMMARY OF THE INVENTION

The floor drain assembly of the present invention comprises a base having an outlet for connection to a sewer system and an upper mounting surface to which a barrel assembly is connected. The barrel assembly flares out at the top to some specified diameter to allow drainage. The flared out area at the top is covered by a grate so as not to impede drainage but provide protection from debris entering the drainage system and clogging the sewer pipes. The grate is supported around the perimeter of the flared out area and at a plurality of locations radially inwardly of the perimeter to decrease the span of the grate so that the grate can be made thinner than would otherwise be possible if the grate were only supported at the perimeter.

DETAILED DESCRIPTION OF THE DISCLOSED INVENTION

Figure 1:
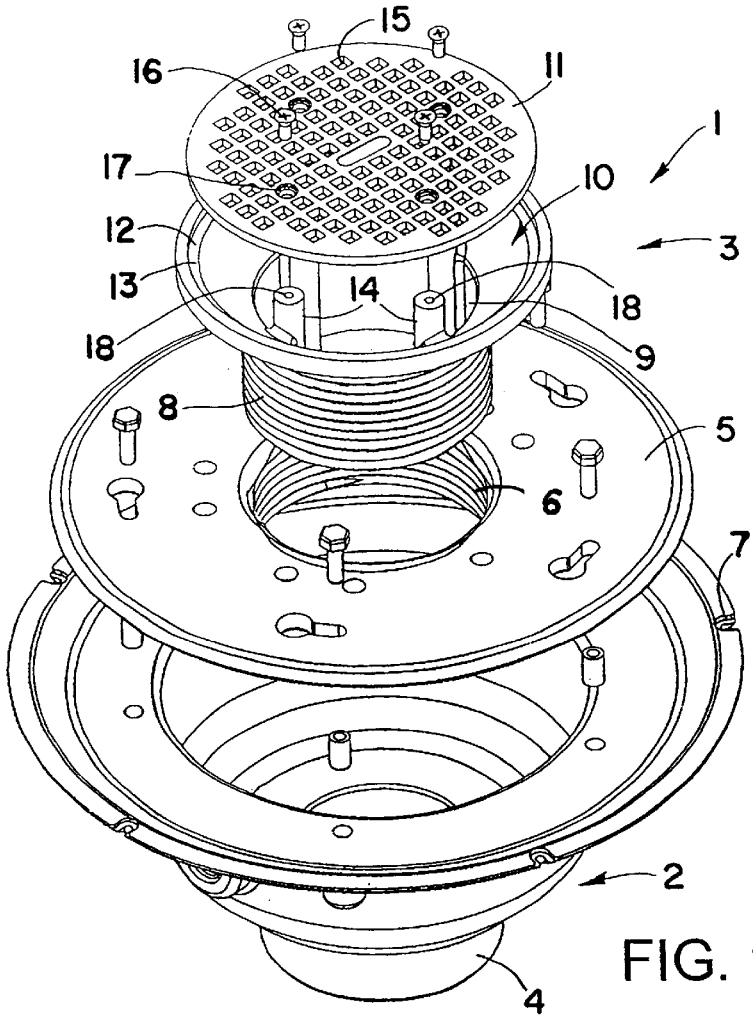
FIG. 1 is an exploded front perspective view of one form of floor drain assembly of the present invention.
Figure 2:
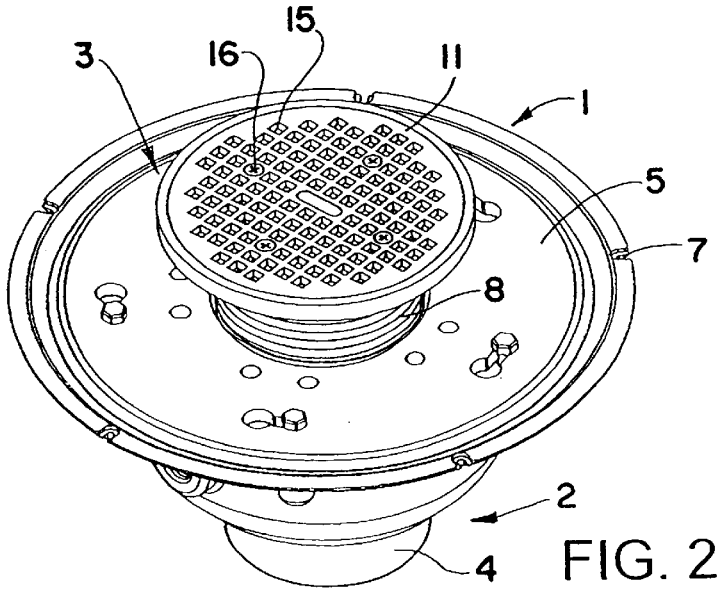
FIG. 2 is a front perspective view showing the floor drain assembly of FIG. 1 assembled.

Referring to the drawings, and initially to FIGS. 1 and 2, there is shown one form of floor drain assembly 1 in accordance with the present invention which consists of two main sections, a bottom section or base 2 and a top section or barrel assembly 3. The base 2 provides a connection to the plumbing system through a union with the outlet 4 that can be either chemically or mechanically connected. Bolted on to the base 2 is a clamping ring or collar 5 that has a threaded bore 6 for threaded engagement by the barrel assembly 3.

The opposed surfaces of the base 2 and clamping collar 5 provide a means of clamping a waterproof membrane to the drain assembly. Anchor slots 7 around the perimeter of the base provide a means of anchoring the drain assembly 1 to a substrate of a floor area.

Figure 4:
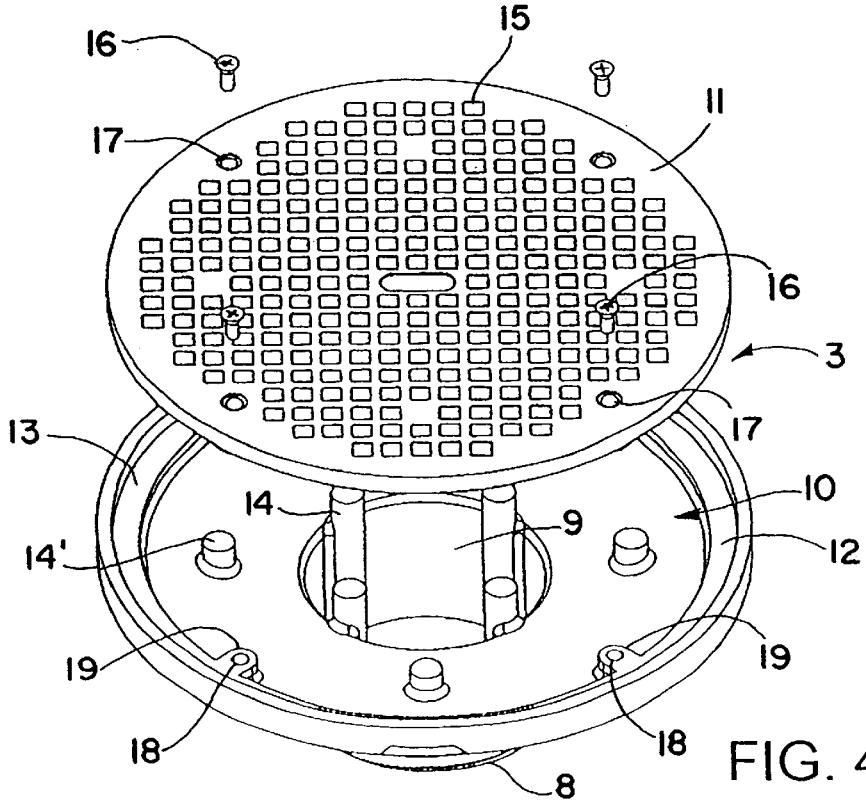
FIG. 4 is an enlarged exploded front perspective view of the barrel assembly of FIG. 3.
Figure 5:
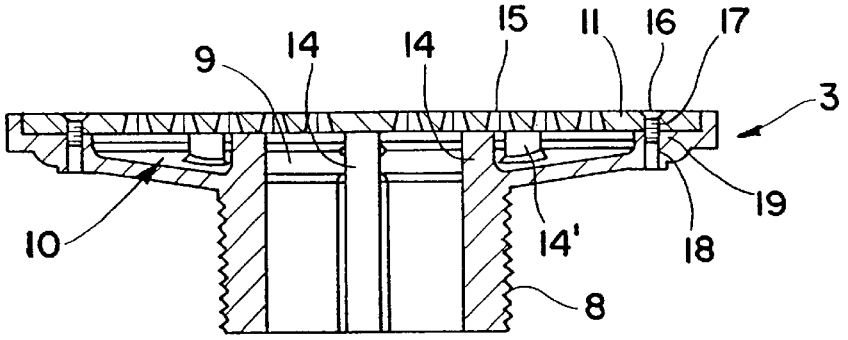
FIG. 5 is a vertical section through the barrel assembly of FIGS. 3 and 4 assembled.
Figure 6:
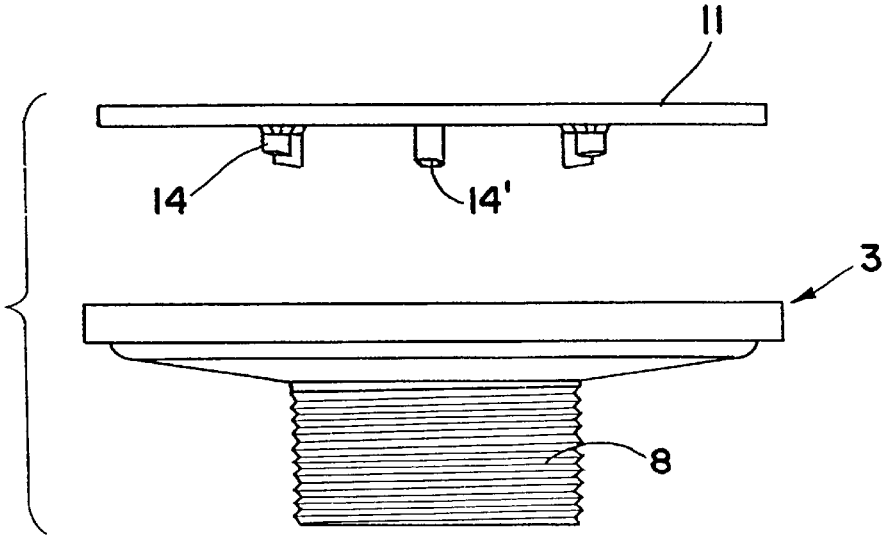
FIG. 6 is an exploded side elevation view of another form of barrel assembly of the present invention.

The barrel assembly 3 includes an exteriorly threaded barrel body 8 for threaded engagement with the threaded center opening 6 in the clamping collar 5 to provide for adjustment of the height of the barrel assembly relative to the base. If a waterproof membrane is not needed, the clamping collar 5 can be eliminated and the barrel assembly 3 threadedly connected directly to the base 2 if desired. The threaded barrel body 8 contains a center drain opening 9 that flares radially out at the top to provide a larger drain area 10 which is covered by a grate 11 that provides protection from debris entering the drainage system and clogging the sewer pipes. The grate 11 is supported around the perimeter 12 of the larger drain area 10 by a ledge 13 and at a plurality of locations radially inwardly of the ledge by a plurality of support columns 14 which may be integral with the barrel body 8 as shown in FIGS. 1–5 or integral with the underside of the grate as schematically shown in FIG. 6. The number and location of the support columns 14 needed to support the span of the grate 11 will depend on the diameter of the span and how thin the grate is. For example, the drain area 10 of the barrel assembly 3 shown in FIGS. 3–5 has two (or more) sets of circumferentially spaced support columns 14, 14' located at different radial distances from the support ledge 13 rather than a single set of circumferentially spaced support columns 14 as shown in FIGS. 1 and 2 because of the larger diameter grate span shown in FIGS. 3–5. In FIG. 1 all of the support columns 14 are shown integral with the wall of the drain opening 9 to place them closer to the center, whereas in FIGS. 4 and 6 additional support columns 14' are shown integral with the upper surface of the drain area 10 radially (and circumferentially) spaced from the support columns 14.

Figure 3:
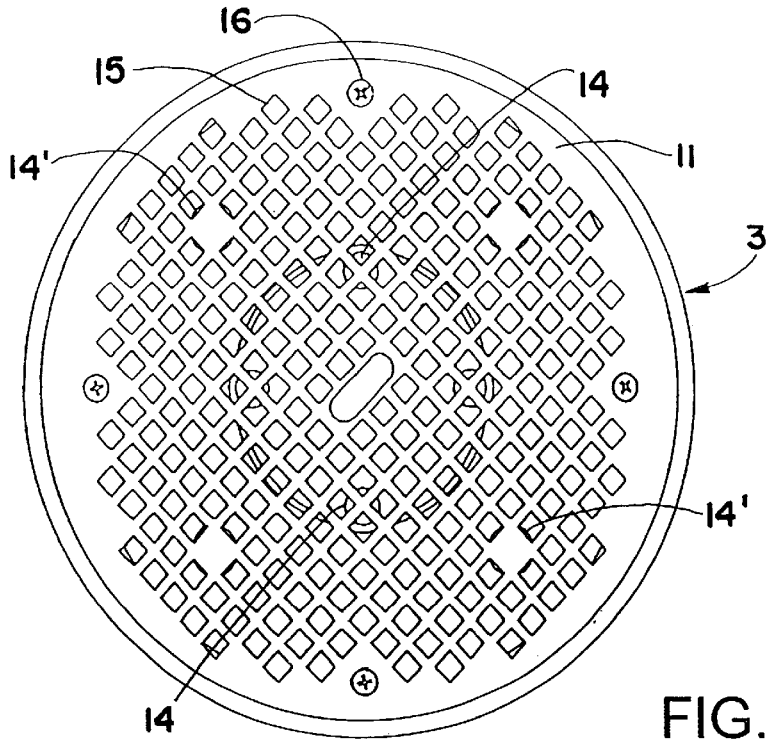
FIG. 3 is a top plan view of the barrel assembly of another form of floor drain assembly of the present invention.

In general it is preferable to keep the grate relatively thin for economic reasons and to prevent the grate holes 15 from becoming points of flow restriction and potential clogs. The columns 14, 14' decrease the span of the grate 11 and place the drain assembly 1 primarily in compression. The grate 11 is secured to the barrel assembly 3 by screws 16 extending through holes 17 in the grate into threaded engagement with threaded openings 18 either in the upper ends of selected columns 14 integral with the barrel body 8 as shown in FIGS. 1 and 2 or in separate bosses 19 integral with the barrel body adjacent the support ledge 13 as shown in FIGS. 3–5.

If desired, a cover plate could be used in place of the grate to convert the floor drain to a cleanout. Also, a plurality of supports may be provided on the barrel body or cover plate radially inwardly of the ledge (similar to the supports 14, 14' previously described) for providing additional support for the span of the cover plate so a thinner cover plate can be used for economic reasons and still provide a plate with high load bearing characteristics.

Although the invention has been shown and described with respect to certain embodiments, it is obvious that equivalent alterations and modifications will occur to others skilled in the art upon the reading and understanding of the specification. In particular, with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function in the herein illustrated exemplary embodiment of the invention. In addition, while a particular feature of the invention may have been disclosed with respect to only one embodiment, such feature may be combined with one or more other features of other embodiments as may be desired and advantageous for any given or particular application.

What is claimed is:

1. A floor drain assembly comprising a barrel assembly having a drain opening and a radially outwardly flared drain area surrounding said drain opening, and a grate for covering said drain opening and said drain area, said grate being supported above said drain opening and said drain area by a raised ledge surrounding said drain area above said drain opening and said drain area and by a plurality of spaced apart supports contacting an underside of said grate spaced radially inwardly from said ledge.

2. The assembly of claim 1 wherein said supports are integral with an underside of said grate and extend downwardly therefrom below said ledge into contact with said drain area radially inwardly of said ledge for supporting said grate above said drain opening and said drain area.

3. The assembly of claim 1 wherein there are at least two sets of circumferentially spaced supports located at different radial distances radially inwardly of said ledge.

4. The assembly of claim 1 wherein said supports are integral with said barrel assembly and extend upwardly above said drain opening and said drain area into contact with the underside of said grate radially inwardly of said ledge.

5. The assembly of claim 4 further comprising fasteners for securing said grate to said barrel assembly, selected ones of said supports having threaded openings for threaded receipt of said fasteners.

6. The assembly of claim 1 wherein threaded openings are provided in said ledge for threaded receipt of fasteners for securing said grate to said ledge radially outwardly of said supports.

7. The assembly of claim 1 wherein at least some of said supports are integral with an axial wall of said drain opening and extend upwardly above said drain area into contact with the underside of said grate.

8. The assembly of claim 1 wherein at least some of said supports are integral with said drain area and extend upwardly above said drain area into contact with the underside of said grate.

9. The assembly of claim 1 further comprising a base having an outlet for connection to a sewer system, said barrel assembly being connectable to said base with said drain opening in fluid communication with said outlet.

10. The assembly of claim 9 further comprising a clamping ring attachable to said base, said clamping ring having a threaded bore, and said barrel assembly being externally threaded for threaded engagement with said threaded bore.

11. A floor drain assembly comprising a barrel assembly having a drain opening and a radially outwardly flared drain area surrounding said drain opening, and a grate for covering said drain opening and said drain area, said grate being supported above said drain opening and said drain area by at least two sets of circumferentially spaced supports contacting an underside of said grate located at different radial distances from an axial center of said drain opening.

12. The assembly of claim 11 wherein at least some of said supports are integral with an underside of said grate and extend downwardly therefrom into contact with said drain area.

13. The assembly of claim 11 wherein at least some of said supports are integral with said barrel assembly and extend upwardly above said drain opening and said drain area into contact with the underside of said grate.

14. The assembly of claim 11 wherein at least some of said supports are integral with an axial wall of said drain opening and extend upwardly above said drain area into contact with the underside of said grate.

15. The assembly of claim 11 wherein at least some of said supports are integral with said drain area and extend upwardly above said drain area into contact with the underside of said grate.

* * * * *